US006349446B1

(12) United States Patent
Krause et al.

(10) Patent No.: US 6,349,446 B1
(45) Date of Patent: Feb. 26, 2002

(54) QUICK RELEASE BUFFING PAD ASSEMBLY

(75) Inventors: Aaron C. Krause, Folcroft; Saul D. Denenberg, Blue Bell, both of PA (US)

(73) Assignee: Dedication to Detail, Inc., Folcroft, PA (US)

( * ) Notice: Subject to any disclaimer, the term of this patent is extended or adjusted under 35 U.S.C. 154(b) by 0 days.

(21) Appl. No.: 09/536,443

(22) Filed: Mar. 28, 2000

(51) Int. Cl.[7] ..... B24D 13/14
(52) U.S. Cl. ..... 15/230; 15/230.12
(58) Field of Search ..... 15/28, 52, 180, 15/230, 230.12, 230.14

(56) References Cited

U.S. PATENT DOCUMENTS

| | | | |
|---|---|---|---|
| 2,671,994 A | | 3/1954 | Hickman |
| 3,537,832 A | | 11/1970 | Johnson |
| 3,742,656 A | | 7/1973 | Amos |
| 4,104,760 A | | 8/1978 | Rosseau |
| 4,607,412 A | | 8/1986 | Ashworth |
| 4,799,282 A | | 1/1989 | Fischer |
| 5,249,329 A | * | 10/1993 | Arnold |
| 5,421,053 A | | 6/1995 | Chodak |
| 5,461,750 A | | 10/1995 | Kaiser |
| 5,697,115 A | | 12/1997 | Sciarra et al. |

* cited by examiner

*Primary Examiner*—Randall E. Chin
(74) *Attorney, Agent, or Firm*—Norman E. Lehrer

(57) ABSTRACT

A buffing pad assembly having a right pad, a left pad, a disk securing the two pads together, and an elongated member for releasably attaching the buffing pad to the drive shaft of a buffing motor is disclosed. Each pad has a central aperture. The disk has a connector located in the center thereof. The connector has an opening therethrough. The right and left pads are secured to first and second faces, respectively, of the disk so that the apertures and opening are aligned when the buffing pad is assembled. The elongated member has a body, a head, and an indented area separating the head and the body. The head fits through either of the apertures and through the opening of the connector. The elongated member also has an open end which may be secured to the spindle of a buffing motor. Contained within the indented area is an O-ring which releasably secures the elongated member within the opening yet allows for the pad to be easily snapped off of the elongated member so that either side of the buffing pad may be used.

8 Claims, 2 Drawing Sheets

QUICK RELEASE BUFFING PAD ASSEMBLY

BACKGROUND OF THE INVENTION

The present invention is directed toward a buffing pad assembly and more particularly, toward a two-sided pad which may be quickly released from a buffing motor, reversed, and reattached to the motor.

Buffing pads for use in high speed polishing of automobiles and the like may be one-sided or two-sided. A one-sided buffing pad is typically circular and is attached to a rigid circular backing plate which is attached by a central hub to the shaft of a rotary power buffer. The pad may be permanently attached to the backing plate or releasably attached thereto in order to allow for replacement without disposing of the backing plate. A two-sided pad includes a buffing pad attached to each face of a rigid backing plate. The plate includes a hub for releasably attaching the pad to the drive shaft or spindle of a high speed buffing motor. The pad may be attached to the motor from either side of the pad, thereby allowing the pad to be reversed after one side has been used.

A two-sided pad is disclosed in U.S. Pat. No. 4,607,412 to Ashworth. This patent discloses a reversible buffing pad where either side of the pad may be used. The hub may be screwed onto the drive shaft of a buffing motor from either side of the hub. The problem with this type of releasable attachment, however, is that it becomes time-consuming to stop the motor, unscrew the pad, reverse the pad, and then screw the pad back onto the drive shaft.

U.S. Pat. No. 5,461,750 to Kaiser discloses a two-sided rotary buffing pad. That is, a pad is attached to opposite faces of a rigid backing plate. Either side of the pad may be used. A hub is attached to the plate where the hub has a threaded bore by which it is demountably and reversibly attached to the threaded end of the shaft of a power buffer. Again, the problem with this type of releasable attachment is that it becomes time-consuming to stop the motor, unscrew the pad, reverse the pad, and then screw the pad back onto the drive shaft.

A need exists for a reversible buffing pad which is quickly and easily released from the spindle of a buffing motor, reversed, and then reattached to the spindle.

SUMMARY OF THE INVENTION

The present invention is designed to overcome the deficiencies of the prior art discussed above. It is an object of the present invention to provide a quick release for a two-sided buffing pad.

In accordance with the illustrative embodiments demonstrating features and advantages of the present invention, there is provided a two-sided buffing pad assembly having a right pad, a left pad, a disk securing the two pads together, and means for releasably attaching the buffing pad to the spindle of a buffing motor. Each pad has a central aperture. The disk has a connector located in the center thereof. The connector has an opening therethrough. The right and left pads are secured to first and second faces, respectively, of the disk so that the apertures and opening are aligned when the buffing pad is assembled. The elongated member has a body, a head, and an indented area separating the head and the body. The head fits through either of the apertures and through the opening of the connector. The elongated member also has an open end which may be secured to the spindle of a buffing motor. Contained within the indented area is an O-ring which releasably secures the elongated member within the opening yet allows for the pad to be easily snapped off of the elongated member so that either side of the buffing pad may be used.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
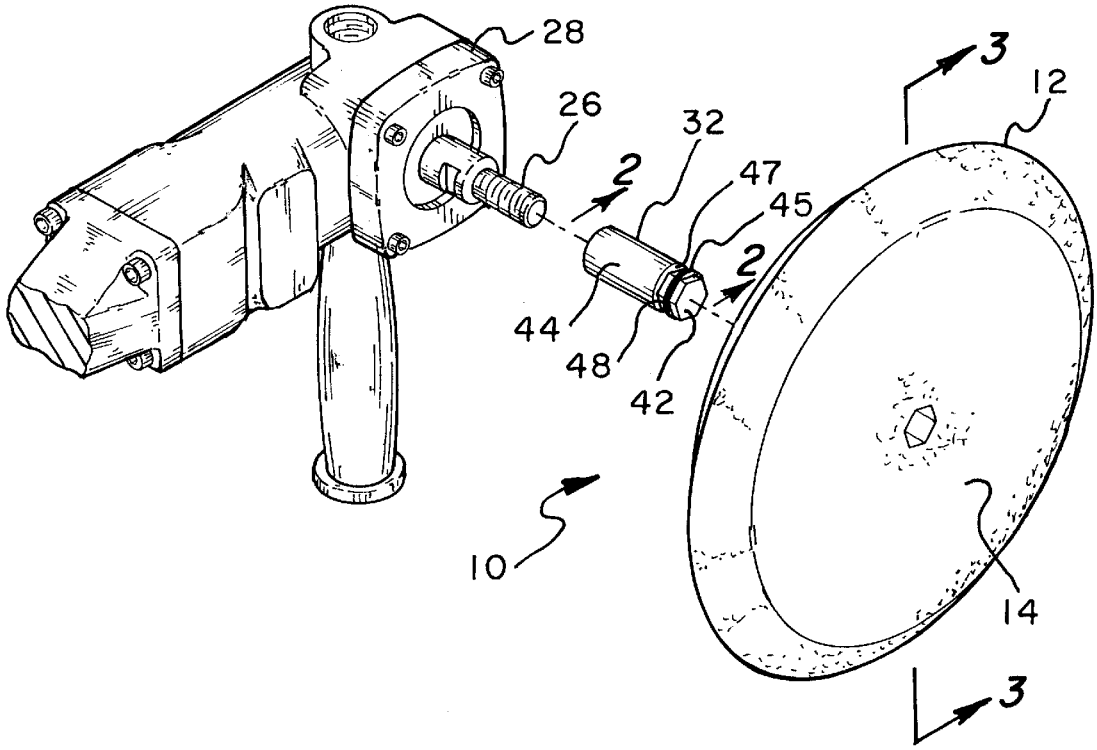
FIG. 1 is an exploded view of the quick release buffing pad assembly of the present invention fitting onto the spindle of a buffing motor.

Referring now to the drawings in detail wherein like reference numerals have been used throughout the various figures to designate like elements, there is shown in FIG. 1 a buffing pad assembly constructed in accordance with the principles of the present invention and designated generally as 10.

Figure 6:
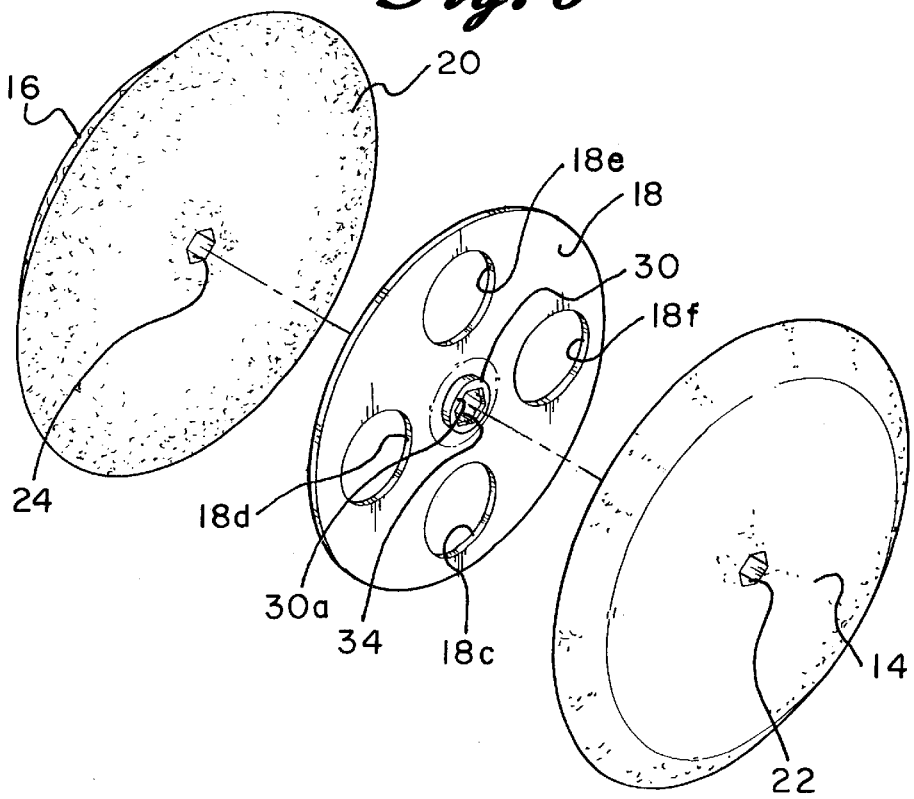
FIG. 6 is an exploded view of the buffing pad of the present invention.
Figure 2:
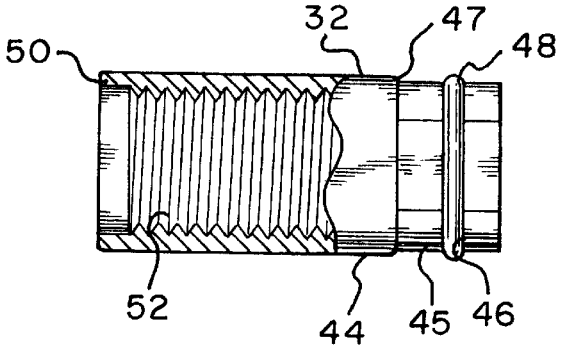
FIG. 2 is a cross-sectional view taken along line 2—2 of FIG. 1.

The present invention essentially includes a quick release buffing pad 12 having a first or right pad 14, a second or left pad 16, and a plate or disk 18 secured between the pads 14 and 16. (See FIG. 6.) The rear surfaces of the right and left pads 14 and 16, respectively (seen as rear surface 20 on left pad 16) are sealed or otherwise secured to first and second faces 18*a* and 18*b*, respectively, of the disk 18. Also, holes 18*c*, 18*d*, 18*e*, and 18*f* in the disk 18 allow the pads 14 and 16 to be glued to each other.

Pad 14 has a first central aperture 22. Likewise, pad 16 has a second central aperture 24. The apertures 22 and 24 are hexagonal. When the right and left pads 14 and 16 are secured together with the disk 18, the apertures 22 and 24 are aligned. Each pad may be made from natural wool, synthetic fibers, closed or open cell synthetic foam, or the like material. Each of the pads may be made from the same type of material or from a type of material different from each other, depending upon the needs of the user. The disk may be made from a thermoplastic material or the like.

Figure 4:
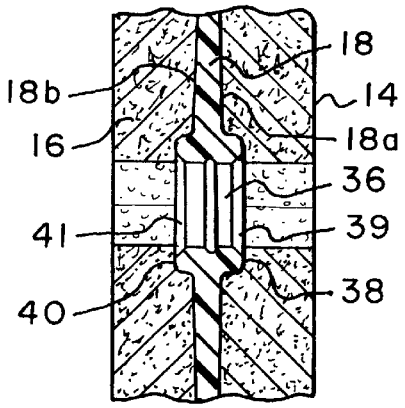
FIG. 4 is a partial cross-sectional view of the buffing pad of the present invention.
Figure 3:
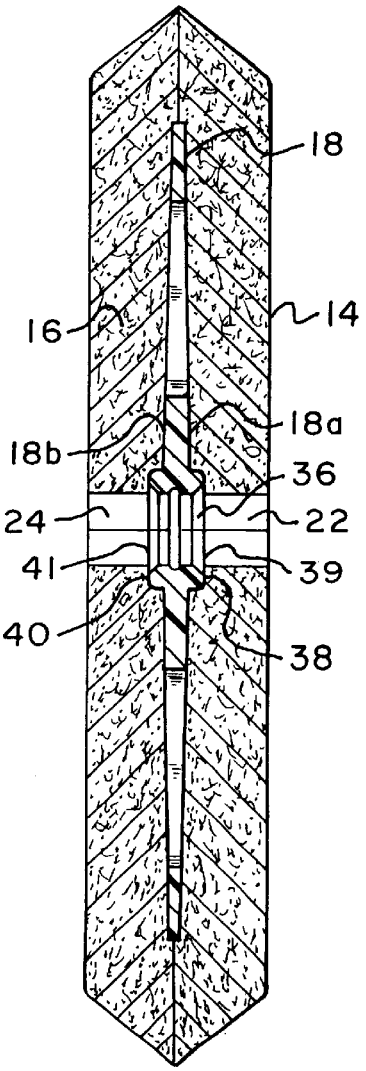
FIG. 3 is a cross-sectional view taken along line 3—3 of FIG. 1.
Figure 5:
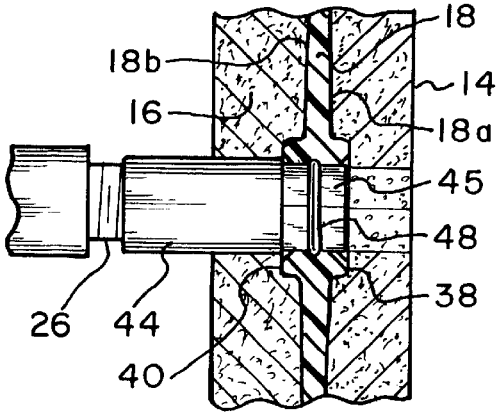
FIG. 5 is a partial cross-sectional view of the buffing pad of the present invention with a spindle inserted through the center of the pad.

The buffing pad 12 also includes means for releasably attaching the same to the spindle 26 of a buffing motor 28. The releasable attaching means includes a plastic connector 30 which extends through the center of the disk 18 and an elongated, generally cylindrical hollow steel or other metallic member 32. (See FIG. 1.) The connector 30 has a hexagonal opening 34 within which is included an annular semicircular recess or groove 36. The opening 34 of the connector 30 is aligned with the apertures 22 and 24 of the pads 14 and 16, respectively. (See FIG. 3.) Both ends 38 and 40 of the connector 30 are flared outwardly as shown at 39 and 41. (See FIG. 4.)

The elongated, generally cylindrical member 32 has a hexagonal head 42 and a body 44 with an indented area 45 located between the head 42 and the body 44. A groove 46 is located within the indented area 45. Located securely within the groove 46 is an O-ring 48 which may be made from rubber or similarly resilient material. The flexibility of the rubber of the O-ring may be varied so that different types of pads may be used. The head 42 fits within the opening 34 of the connector 30 with the O-ring 48 fitting into the groove 36 within the connector 30.

As a result of the ends 38 and 40 of the connector 30 being flared and the apertures 22 and 24 being hexagonal, the head 42 can be easily guided therein through either aperture 22 or 24. However, while the apertures 22 and 24 may be the same size as the opening 34, the apertures 22 and 24 are smaller than the end face 30*a* of the connector 30 so that when one side of the buffing pad 12 is pushed against a car, the foam around the apertures 22 and 24 will prevent the plastic of the end face 30*a* of the connector 30 from touching the car. The end 50 of the member 32 is open and has means 52 for securing the member 32 to the spindle 26 of a buffing motor 28 as will be described in more detail below.

In order to use the present invention, the open end 50 of the member 32 is secured to the spindle 26 of a buffing motor 28. The head 42 of the member 32 is inserted within the aperture 24 of the left pad 16 and the opening 34. The member 32 is releasably or temporarily secured or friction fit within the opening 34 by way of the O-ring 48 located within the groove 46 that snaps into the recess 36. The disk 18 is stopped by shoulder 47 of member 32, thereby preventing the disk 18 from sliding back along the member 32 and interfering with the operation of the motor 28. If the buffing pad 12 needs to be reversed, the motor 28 is stopped and the pad 12 is pulled off of the member 32 which remains attached to the spindle 26. The pad 12 is then reversed and pushed or snapped back onto the member 32.

The above-described arrangement of an O-ring 48 being carried by the member 32 and cooperating with the opening 34 of the connector 30 is by way of example only. That is, other means for temporarily securing the member 32 and the connector 30 together are possible. For example, a resilient member may be carried by the opening 34 which cooperates with member 32.

While the drive shaft 26 and member 32 have been shown as having screw threads which are the means used to secure the member to the drive shaft, other securing or fastening means known in the art may be used. Also, the motor may be a right angle high speed buffer. Furthermore, while the head 42, apertures 22 and 24, and opening 34 are described as being hexagonal, it should be realized that any non-circular or non-round shape may be used. Also, the head, apertures, and opening should be complementary to each other.

The present invention may be embodied in other specific forms without departing from the spirit or essential attributes thereof and accordingly, reference should be made to the appended claims rather than to the foregoing specification as indicating the scope of the invention.

We claim:

1. A quick release buffing pad assembly comprising:

a first pad having a first central aperture;

a second pad having a second central aperture;

a plate having a first face, a second face, and a connector having a non-circular opening located in the center of said plate, said first pad being secured to said first face and said second pad being secured to said second face so that said first and second apertures and said opening are aligned when said pads are secured to said plate; and an elongated, generally cylindrical member having a body and a non-circular head, said head being complementary to said non-circular opening of said connector and being adapted to fit therein, and means for temporarily securing said non-circular head within said opening of said connector.

2. The quick release buffing pad assembly of claim 1 wherein said means for temporarily securing includes one of said head and opening carrying a resilient member adapted to cooperate with the other of said head and opening.

3. The quick release buffing pad assembly of claim 2 wherein said means for temporarily securing includes said head carrying a resilient member adapted to cooperate with said opening.

4. The quick release buffing pad assembly of claim 3 wherein said resilient member is an O-ring.

5. The quick release buffing pad assembly of claim 1 wherein said head and said opening are hexagonal.

6. The quick release buffing pad assembly of claim 1 wherein said body of said member further includes an open end adapted to be secured onto a buffing drive motor.

7. The quick release buffing pad assembly of claim 1 wherein said first and second pads are made from foam.

8. The quick release buffing pad assembly of claim 1 wherein the ends of said opening of said connector are flared.

* * * * *